US006075462A

United States Patent [19]

Smith

[11] Patent Number: 6,075,462

[45] Date of Patent: Jun. 13, 2000

[54] ADJACENT WELL ELECTROMAGNETIC TELEMETRY SYSTEM AND METHOD FOR USE OF THE SAME

[76] Inventor: Harrison C. Smith, 10468 County Rd. 288, Anna, Tex. 75409

[21] Appl. No.: 08/977,218

[22] Filed: Nov. 24, 1997

[51] Int. Cl.[7] ..... G01V 3/00

[52] U.S. Cl. ..... 340/854.6; 340/853.7; 340/854.8; 166/250.15; 166/66; 324/338; 324/339

[58] Field of Search ..... 340/853.6, 853.1, 340/855.4, 854.4, 853.7, 854; 166/250.15, 313, 250.01, 66, 64, 65.1; 324/323, 342, 338, 339

[56] References Cited

U.S. PATENT DOCUMENTS

| | | | |
|---|---|---|---|
| 1,220,005 | 3/1917 | Rogers et al. . | |
| 1,757,288 | 5/1930 | Bleecker . | |
| 2,992,325 | 7/1961 | Lehan | 250/3 |
| 3,233,674 | 2/1966 | Leutwyler | 166/63 |
| 3,333,239 | 7/1967 | Silverman | 340/18 |
| 3,737,845 | 6/1973 | Maroney et al. | 340/18 P |
| 3,967,201 | 6/1976 | Rorden | 325/28 |
| 4,348,672 | 9/1982 | Givier | 340/854 |
| 4,387,372 | 6/1983 | Smith et al. | 340/854 |
| 4,468,665 | 8/1984 | Thawley et al. | 340/856 |
| 4,496,174 | 1/1985 | McDonald et al. | 285/53 |
| 4,525,715 | 6/1985 | Smith | 340/854 |
| 4,617,960 | 10/1986 | More | 137/554 |
| 4,667,736 | 5/1987 | Rumbaugh et al. | 166/65.1 |
| 4,684,946 | 8/1987 | Issenmann | 340/855 |
| 4,722,393 | 2/1988 | Rumbaugh | 166/217 |
| 4,725,837 | 2/1988 | Rubin | 340/855 |
| 4,736,791 | 4/1988 | Rorden et al. | 166/66.4 |
| 4,753,484 | 6/1988 | Stolarczyk et al. | 299/1 |
| 4,787,053 | 11/1988 | Moore | 364/551.01 |
| 4,796,708 | 1/1989 | Lembcke | 166/386 |
| 4,915,168 | 4/1990 | Upchurch | 166/250 |
| 4,933,640 | 6/1990 | Kuckes | 324/339 |
| 4,953,616 | 9/1990 | Borden et al. | 166/66.4 |
| 5,130,706 | 7/1992 | Van Steenwyk | 340/854.6 |
| 5,226,494 | 7/1993 | Rubbo et al. | 166/250 |
| 5,358,035 | 10/1994 | Grudzinski | 166/53 |
| 5,394,141 | 2/1995 | Soulier | 340/854.4 |
| 5,412,568 | 5/1995 | Schultz | 364/422 |
| 5,465,206 | 11/1995 | Hilt et al. | 364/406 |
| 5,465,786 | 11/1995 | Akkerman | 166/66.4 |
| 5,465,787 | 11/1995 | Roth | 166/66.4 |
| 5,530,358 | 6/1996 | Wisler et al. | 324/338 |
| 5,531,270 | 7/1996 | Fletcher et al. | 166/53 |
| 5,547,029 | 8/1996 | Rubbo | 166/375 |
| 5,558,153 | 9/1996 | Holcombe et al. | 166/373 |
| 5,597,042 | 1/1997 | Tubel et al. | 166/250.01 |
| 5,662,165 | 9/1997 | Tubel et al. | 166/250.01 |
| 5,706,892 | 1/1998 | Aeschbacher | 166/66 |
| 5,706,896 | 1/1998 | Tubel et al. | 166/313 |
| 5,721,538 | 2/1998 | Tubel et al. | 340/853.4 |
| 5,730,219 | 3/1998 | Tubel et al. | 166/250.01 |
| 5,732,776 | 3/1998 | Tubel et al. | 166/250.15 |

FOREIGN PATENT DOCUMENTS

| | | |
|---|---|---|
| 2317 406 | 3/1998 | United Kingdom . |

*Primary Examiner*—Michael Horabik
*Assistant Examiner*—Albert K. Wong

[57] ABSTRACT

An adjacent well telemetry system for changing the operational state of a downhole device and a method for use of the system is disclosed. The system comprises an electromagnetic transmitter disposed in a wellbore that transmits an command signal that is received by an electromagnetic receiver disposed in an adjacent wellbore. The electromagnetic receiver sends the command signal to an electronics package that generates a driver signal in response to the command signal that prompts the downhole device to change operational states.

50 Claims, 10 Drawing Sheets

10
12
14
15
16
18
20
22
24
26
28
30
32
34
36
37
38
40
42
43
44
46
48
50
52
53
54
55
56
57
58
59
60
61
62
63
64
66
68
70
72
74
76
78
80
82
84
86

ADJACENT WELL ELECTROMAGNETIC TELEMETRY SYSTEM AND METHOD FOR USE OF THE SAME

TECHNICAL FIELD OF THE INVENTION

This invention relates in general to downhole telemetry and, in particular to, an electromagnetic telemetry system for sending and receiving signals between downhole locations in adjacent wells.

BACKGROUND OF THE INVENTION

Without limiting the scope of the invention, its background is described in connection with communication between surface equipment and downhole devices during hydrocarbon production, as an example. It should be noted that the principles of the present invention are applicable not only during production, but throughout the life of a wellbore including, but not limited to, during drilling, logging, testing and completing the wellbore.

Heretofore, in this field, a variety of communication and transmission techniques have been attempted to provide real time communication between surface equipment and downhole devices. The utilization of real time data transmission provides substantial benefits during the production of hydrocarbons from a field. For example, monitoring of downhole conditions allows for an immediate response to potential well problems including production of water or sand.

One technique used to telemeter downhole data to the surface uses the generation and propagation of electromagnetic waves. These waves are produced by inducing an axial current into, for example, the production casing. This current produces the electromagnetic waves that include an electric field and a magnetic field, which are formed at right angles to each other. The axial current impressed on the casing is modulated with data causing the electric and magnetic fields to expand and collapse thereby allowing the data to propagate and be intercepted by a receiving system. The receiving system is typically connected to the ground or sea floor at the surface where the electromagnetic data is picked up and recorded.

As with any communication system, the intensity of the electromagnetic waves is directly related to the distance of transmission. As a result, the greater the distance of transmission, the greater the loss of power and hence the weaker the received signal at the surface. Additionally, downhole electromagnetic telemetry systems must transmit the electromagnetic waves through the earth's strata. In free air, the loss is fairly constant and predictable. When transmitting through the earth's strata, however, the amount of signal received is dependent upon the skin depth ($\delta$) of the media through which the electromagnetic waves travel. Skin depth is defined as the distance at which the power from a downhole signal will attenuate by a factor of 8.69 db (approximately 7 times decrease from the initial power input), and is primarily dependent upon the frequency (f) of the transmission and the conductivity ($\sigma$) of the media through which the electromagnetic waves are propagating. For example, at a frequency of 10 hz, and a conductance of 1 mho/meter (1 ohm-meter), the skin depth would be 159 meters (522 feet). Therefore, for each 522 feet in a consistent 1 mho/meter media, an 8.69 db loss occurs. Skin depth may be calculated using the following equation.

$$\text{Skin Depth} = \delta = 1 / \sqrt{(\pi f \mu \sigma)} \quad \text{where:}$$

$\pi$=3.1417;

f=frequency (hz);

$\mu$=permeability ($4\pi\times10^{6}$); and $\sigma$=conductance (mhos/meter).

As should be apparent, the higher the conductance of the transmission media, the lower the frequency must be to achieve the same transmission distance. Likewise, the lower the frequency, the greater the distance of transmission with the same amount of power.

A typical electromagnetic telemetry system that transmits vertically through the earth's strata may successfully propagate through ten (10) skin depths. In the example above, for a skin depth of 522 feet, the total transmission and successful reception depth would only be 5,220 feet. It has been found, however, that when transmitting horizontally through a single or limited number of strata, the vagaries of the strata are small and the media more conductivity consistent which allows for a greater distance of transmission.

Therefore, a need has arisen for a downhole telemetry system that is capable of communicating real time information over a great distance between downhole devices disposed in multiple wellbores using horizontal transmission through a single or limited number of strata. A need has also arisen for such a system that is capable of telemetering the information between the downhole devices and the surface. Further, a need has arisen for a system that uses electromagnetic waves to transmit real time information between downhole devices through a single or limited number of strata and that uses electrical signals to transmit the information between a single downhole device and the surface.

SUMMARY OF THE INVENTION

The present invention disclosed herein comprises an adjacent well downhole telemetry system and a method for use of the same that is capable of transmitting real time information over a great distance between downhole devices disposed in adjacent wellbores and between downhole devices and the surface. The system utilizes electromagnetic waves traveling through a single or limited number of strata to transmit real time information between downhole devices and uses electrical signals to transmit the real time information between a single downhole device and the surface.

The adjacent well telemetry system and method of the present invention comprising a surface installation that transmits a command signal via wireless communication or an electrical wire to a master sonde disposed in a wellbore. The master sonde includes an electromagnetic transmitter that electromagnetically transmits the command signal to and slave sonde having an electromagnetic receiver disposed in an adjacent wellbore that is within the range of the electromagnetic transmission. An electronics package in the slave sonde generates a driver signal in response to the command signal that prompts a downhole device, such as a valve, a packer, a sliding sleeve or a choke, disposed in the adjacent wellbore to change operational states.

The slave sonde may also include an electromagnetic transmitter. The slave sonde may them sends a verification signal to the master sonde, which includes an electromagnetic receiver, indicating the execution of the operation requested in the command signal. The master sonde then transmits the verification signal the surface installation via wireless communication or the electrical wire.

The electromagnetic transmitters and the electromagnetic receivers in the master sonde and the slave sonde may comprises a magnetically permeable annular core, a plurality of primary electrical conductor windings wrapped axially around the annular core and a plurality of secondary electrical conductor windings wrapped axially around the annular core. Alternatively, the electromagnetic transmitters may comprises a pair of electrically isolated terminals between which a voltage is established.

The system and method of the present invention may control a plurality of downhole devices that may be located at separate downhole location in the adjacent wellbore. Likewise, the system and method of the present invention may control a plurality of downhole devices located in a plurality of adjacent wellbores. In this case, the command signal sent by the surface installation to the master sonde will be uniquely associated with a specific downhole device such that the electronics package of a particular slave sonde can determine whether the command signal is uniquely associated with the downhole device controlled by that slave sonde.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
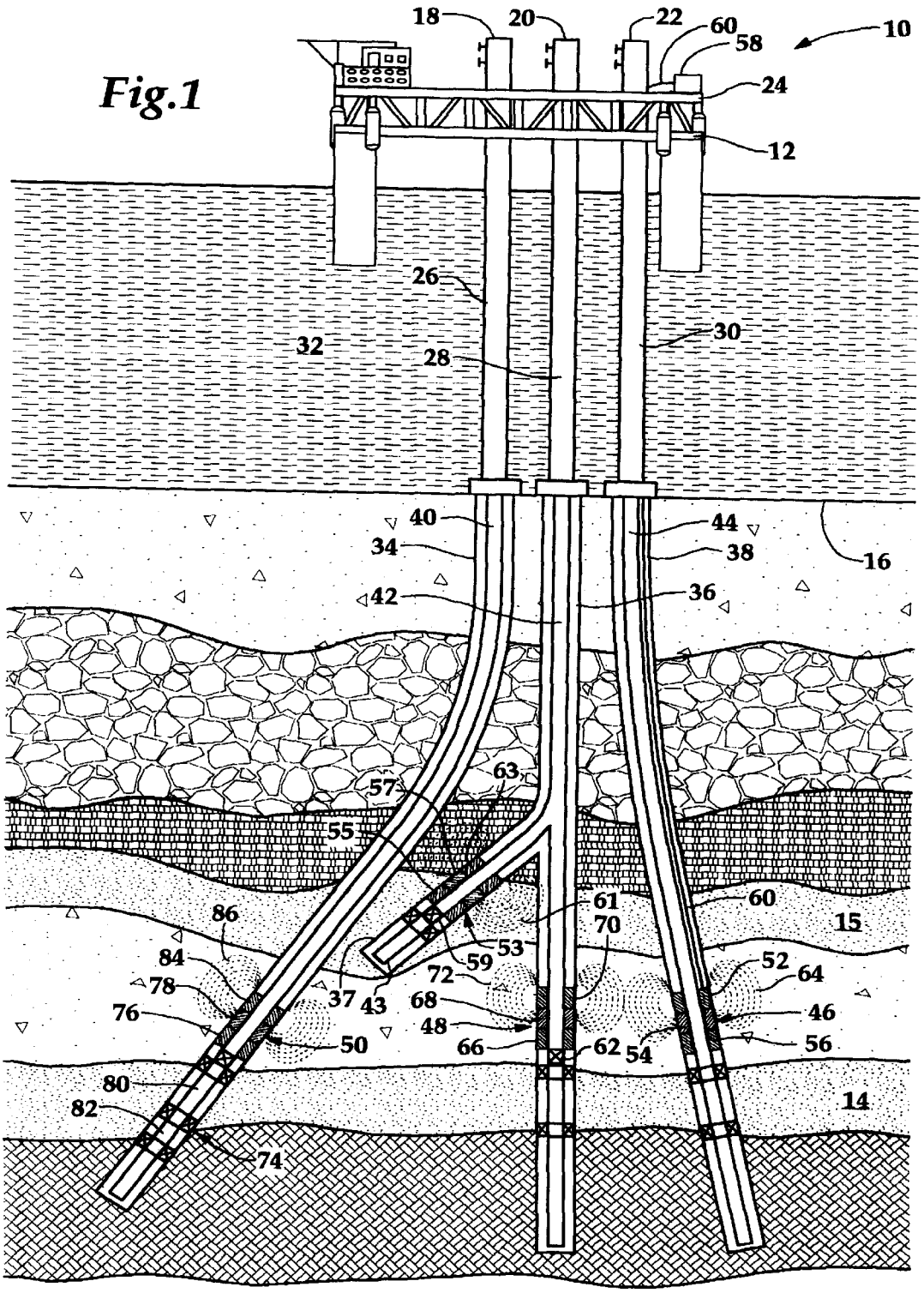
FIG. 1 is a schematic illustration of an offshore oil and gas production platform operating an adjacent well electromagnetic telemetry system of the present invention.

Referring to FIG. 1, an adjacent well telemetry system in use on an offshore oil and gas platform is schematically illustrated and generally designated 10. A semi-submergible platform 12 is centered over a submerged oil and gas formations 14, 15 located below sea floor 16. Wellheads 18, 20, 22 are located on deck 24 of platform 12. Wells 26, 28, 30 extend through the sea 32 and penetrate the various earth strata including formation 14, forming, respectively, wellbores 34, 36, 38, each of which may be cased or uncased and wherein wellbore 36 includes a lateral or branch wellbore 37 that extends from the primary wellbore 36. The lateral wellbore 37 is completed in formation 15 which may be isolated for selective production independent of production from formation 14 into wellbore 36. Also extending from wellheads 18, 20, 22 are tubing 40, 42, 44 which are respectively, disposed in wellbores 34, 36, 38. Tubing 43 is disposed in lateral wellbore 37 and may join tubing 42 for production therethrough.

As part of the final bottom hole assembly prior to production, a master sonde 46 is disposed within wellbore 38 and slave sondes 48, 49, 50 are respectively disposed within wellbores 36, 34. Master sonde 46 includes an electromagnetic transmitter 52, an electronics package 54 and an electromagnetic receiver 56. Electronics package 54 is electrically connected to a surface installation 58 via a hard wire connection such as electrical wire 60. Alternatively, communication between master sonde 46 and surface installation 58 may be achieved using a variety of communication techniques such as acoustic, pressure pulse, radio transmission, microwave transmission, a fiber optics line or electromagnetic waves. Surface installation 58 may be composed of a computer system that processes, stores and displays information relating to formation 14 such as production parameters including temperature, pressure, flow rates and oil/water ratio. Surface installation 58 also maintains information relating to the operational states of the various downhole devices located in wellbores 34, 36, 38. Surface installation 58 may include a peripheral computer or a workstation with a processor, memory, and audiovisual capabilities. Surface installation 58 includes a power source for producing the necessary energy to operate surface installation 58 as well as the power necessary to operate master sonde 46 via electrical wire 60. Electrical wire 60 may be connected to surface installation 58 using an RS-232 interface.

Surface installation 58 is used to generate command signals that will operate various downhole devices. Foor example, if the operator wanted to reduce the flow rate of production fluids in well 28, surface installation 58 would be used to generate a command signal to restrict the opening of bottom hole choke 62. The command signal would be transmitted to master sonde 46 via electrical wire 60. Electronics package 54 of master sonde 46 would process the command signal and forward it to electromagnetic transmitter 52. The command signal would then be radiated into the earth by electromagnetic transmitter 52 in the form of electromagnetic wave fronts 64. Electromagnetic wave fronts 64 are picked up by electromagnetic receiver 66 of slave sonde 48. The command signal is then forwarded to electronics package 68 of slave sonde 48 for processing and amplification. Electronics package 68 interfaces with bottom hole choke 62 and sends a driver signal to bottom hole choke 62 to restrict the flow rate therethrough.

Once the flow rate in well 28 has been restricted by bottom hole choke 62, bottom hole choke 62 interfaces with electronics package 68 of slave sonde 48 to provide verification that the command generated by surface installation 58 has been accomplished. Electronics package 68 then sends the verification signal to electromagnetic transmitter 70 of slave sonde 48 that radiates electromagnetic wave fronts 72 into the earth which are picked up by electromagnetic receiver 56 of master sonde 46. The verification signal is passed to electronics package 46 and onto surface installation 58 via electrical wire 60 and placed in memory.

As another example, the operator may want to shut in production in lateral wellbore 37. As such, surface installation 58 would generate the shut in command signal and forward it to master sonde 46. Master sonde 46 generates electromagnetic wave fronts 64 as described above. The shut in command would be picked up by electromagnetic receiver 55 of slave sonde 53 and processed in electronics package 57 of slave sonde 53. Electronics package 57 interfaces with valve 59 causing valve 59 to close. This change in the operational state of valve 59 would be verified to surface installation 58 as described above, by generating electromagnetic wave fronts 61 by electromagnetic transmitter 63 and transmitting the verification to surface installation 58 via electrical wire 60 after electromagnetic receiver 56 picks up electromagnetic wave fronts 61.

Similarly, the operator may want to actuate a sliding sleeve in a selective completion with sliding sleeves 74. A command signal would again be generated by surface installation 58 and transmitted to electronics package 54 of master sonde 46 via electrical wire 60. Electromagnetic wave fronts 64 would then be generated by electromagnetic transmitter to transmit the command signal to electromagnetic receiver 76 of slave sonde 50. The command signal is forwarded to electronics package 78 for processing, amplification and generation of a driver signal. Electronics package 78 then interfaces with sliding sleeves 80, 82 and sends the driver signal to shut off production from the lower portion of formation 14 by closing sliding sleeve 82 and allow production from the upper portion of formation 14 by opening sliding sleeve 80. Sliding sleeves 80, 82 interface with electronics package 78 of slave sonde 50 to provide verification information regarding their respective changes in operational states. This information is processed and passed to electromagnetic transmitter 84 which generates electromagnetic wave fronts 86. Electromagnetic wave fronts 86 propagated through the earth and are picked up by electromagnetic receiver 56 of master sonde 46. The verification information is then passed to electronics package 54 of master sonde 46 for processing and onto surface installation 58 via electrical wire 60 for analysis and storage.

Each of the command signals generated by surface installation 58 are uniquely associated with a particular downhole device such as bottom hole choke 62, valve 59 or sliding sleeves 80, 82. Thus, as will be further discussed with reference to FIGS. 12 and 13 below, electronics package 68 of slave sonde 46 will only process a command signal that is uniquely associated with a downhole device, such as bottom hole choke 62, located within wellbore 36. Electronics package 57 of slave sonde 53 will only process a command signal that is uniquely associated with a downhole device, such as valve 59, located within lateral wellbore 37. Electronics package 78 of slave sonde 50 will only process a command signal uniquely associated with a downhole device, such as sliding sleeves 80, 82, located within wellbore 34.

As electromagnetic wave fronts 64 travel generally horizontally through a single strata, the range of electromagnetic wave fronts 64 will not be limited by the vagaries of transmission through numerous strata as would be required for vertical transmission of an electromagnetic command signal directly from surface installation 58 to slave sondes 48, 49, 50. Likewise, the transmission of the verification signals as electromagnetic wave fronts 72, 61, 86 respectively from slave sondes 48, 49, 50 are not limited by the vagaries of vertical transmission directly to surface installation 58 in that electromagnetic wave fronts 72, 61, 86 travel generally horizontally to master sonde 46.

Thus, the adjacent well electromagnetic telemetry system of the present invention allows for the monitoring of well data and the control of multiple downhole devices located in multiple wells from one central point.

Additionally, the system of the present invention provides a low cost method of telemetering information and commands between adjacent wells and from a single well to the surface by using disposable slave sondes and by using a retrievable master sonde.

Even though FIG. 1 depicts three wells 26, 28, 30 extending from a single platform 12, it should be apparent to those skilled in the art that the principles of the present invention are applicable to a single platform having any number of wells or to multiple platforms so long as the wells are within the transmission range of the master sonde. As has been noted, the transmission range of electromagnetic waves such as electromagnetic wave fronts 64 is significantly greater when transmitting horizontally through a single or limited number of strata as compared with transmitting vertically through numerous strata. For example, electromagnetic waves such as electromagnetic wave fronts 64 may travel between 3,000 and 6,000 feet vertically while traveling between 15,000 and 30,000 feet horizontally depending on factors such as the voltage induced in the casing, the radius of the casing, the wall thickness of the casing, the length of the casing, the frequency of transmission, the conductance of the transmission media, and the level of noise. As such, the term "adjacent wellbore" as used herein will include any wellbore within the range of electromagnetic waves generated by the master sonde.

Additionally, while FIG. 1 depicts an offshore environment, it should be understood by one skilled in the art that the system of the present invention is equally well suited for operation in an onshore environment.

Figure 2A:
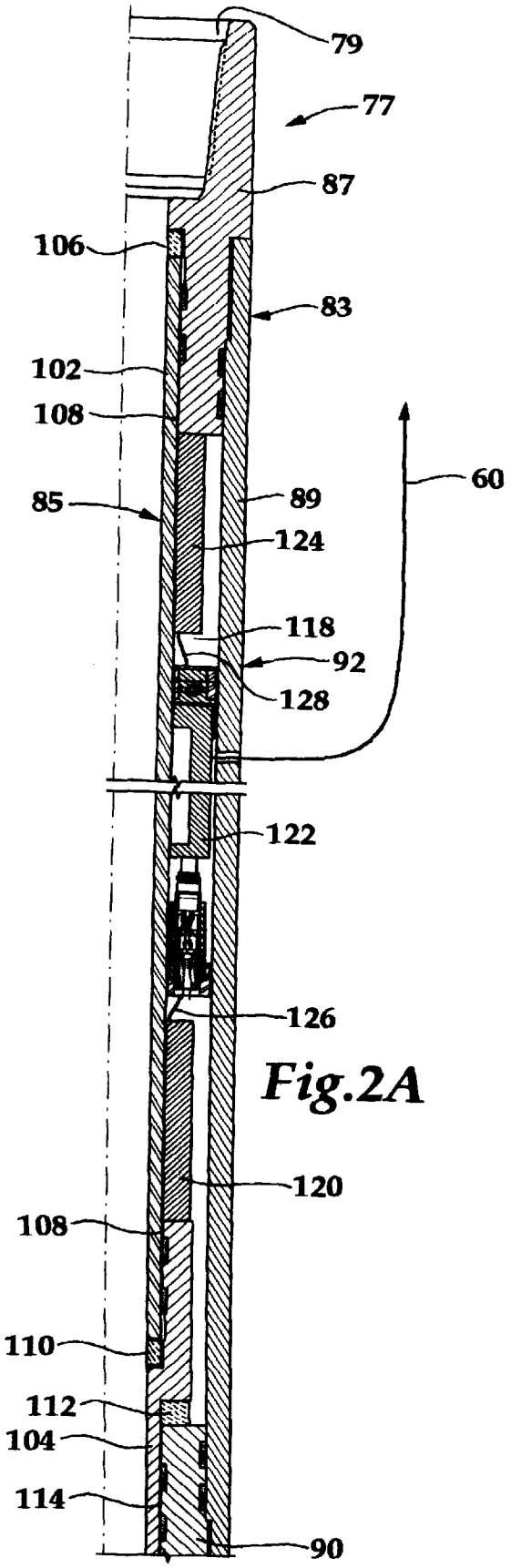
FIGS. 2A–2B are quarter-sectional views of a master sonde of an adjacent well electromagnetic telemetry system of the present invention.
Figure 2B:
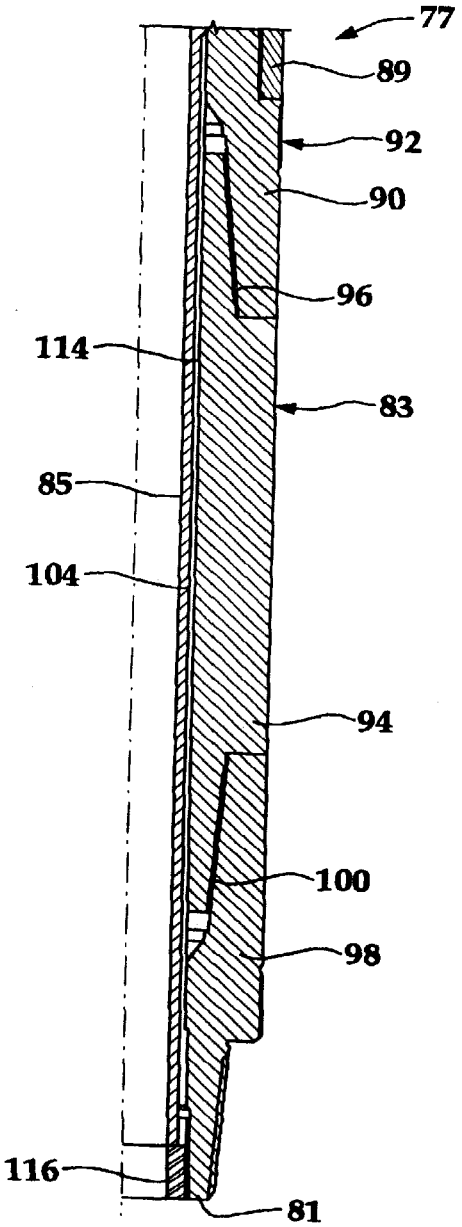

Representatively illustrated in FIGS. 2A–2B is a master sonde 77 of the present invention. For convenience of illustration, FIGS. 2A–2B depict master sonde 77 in a quarter sectional view. Master sonde 77 has a box end 79 and a pin end 81 such that master sonde 77 is threadably adaptable to other tools in a final bottom hole assembly. Master sonde 77 has an outer housing 83 and a mandrel 85 having a full bore so that when master sonde 77 is disposed within a well, tubing may be inserted therethrough. Housing 83 and mandrel 85 protect to operable components of master sonde 77 during installation and production.

Housing 83 of master sonde 77 includes an axially extending and generally tubular upper connector 87. An axially extending generally tubular intermediate housing member 89 is threadably and sealably connected to upper connector 87. An axially extending generally tubular lower housing member 90 is threadably and sealably connected to intermediate housing member 89. Collectively, upper connector 87, intermediate housing member 89 and lower housing member 90 form upper subassembly 92. Upper subassembly 92 is electrically connected to the section of the casing above master sonde 77.

An axially extending generally tubular isolation subassembly 94 is securably and sealably coupled to lower housing member 90. Disposed between isolation subassembly 94 and lower housing member 90 is a dielectric layer 96 that provides electric isolation between lower housing member 90 and isolation subassembly 94. Dielectric layer 96 is composed of a dielectric material, such as teflon, chosen for its dielectric properties and capably of withstanding compression loads without extruding.

An axially extending generally tubular lower connector 98 is securably and sealably coupled to isolation subassembly 94. Disposed between lower connector 98 and isolation subassembly 94 is a dielectric layer 100 that electrically isolates lower connector 98 from isolation subassembly 94. Lower connector 98 is electrically connected to the portion of the casing below master sonde It should be apparent to those skilled in the art that the use of directional terms such as above, below, upper, lower, upward, downward, etc. are used in relation to the illustrative embodiments as they are depicted in the figures, the upward direction being towards the top of the corresponding figure and the downward direction being toward the bottom of the corresponding figure. It is to be understood that the downhole component described herein, for example, master sonde 77, may be operated in vertical, horizontal, inverted or inclined orientations without deviating from the principles of the present invention.

Mandrel 85 includes axially extending generally tubular upper mandrel section 102 and axially extending generally tubular lower mandrel section 104. Upper mandrel section 102 is partially disposed and sealing configured within upper connector 87. A dielectric member 106 electrically isolates upper mandrel section 102 from upper connector 87. The outer surface of upper mandrel section 102 has a dielectric layer disposed thereon. Dielectric layer 108 may be, for example, a teflon layer. Together, dielectric layer 108 and dielectric member 106 serve to electrically isolate upper connector 87 from upper mandrel section 102.

Between upper mandrel section 102 and lower mandrel section 104 is a dielectric member 110 that, along with dielectric layer 108, serves to electrically isolate upper mandrel section 102 from lower mandrel section 104. Between lower mandrel section 104 and lower housing member 90 is a dielectric member 112. On the outer surface of lower mandrel section 104 is a dielectric layer 114 which, along with dielectric member 112, provides for electric isolation of lower mandrel section 104 from lower housing number 90. Dielectric layer 114 also provides for electric isolation between lower mandrel section 104 and isolation subassembly 94 as well as between lower mandrel section 104 and lower connector 98. Lower end 116 of lower mandrel section 104 is disposed within lower connector 98 and is in electrical communication with lower connector 98. Intermediate housing member 89 of outer housing 83 and upper mandrel section 102 of mandrel 85 define annular area 118. A receiver 120, an electronics package 122 and a transmitter 124 are disposed within annular area 118.

In operation, master sonde 77 receives a command signal from surface installation 58 via electrical wire 60. The command signal is processed by electronics package 122 as will be described in more detail with reference to FIG. 11 and passed on to electromagnetic transmitter 124 via electrical conductor 128. The command signal is then radiated into the earth as electromagnetic waves by electromagnetic transmitter 124. After the electromagnetic command signal is received by a slave sonde and the command is executed on a downhole device, a verification signal is returned to master sonde 77 in the form of electromagnetic waves which are picked up by electromagnetic receiver 120 and passed on to electronics package 122 via electrical conductor 126 and processed as will be described with reference to FIG. 11. The verification signal is then forwarded to surface installation 58 via electrical wire 60 for analysis and storage.

Figure 3A:
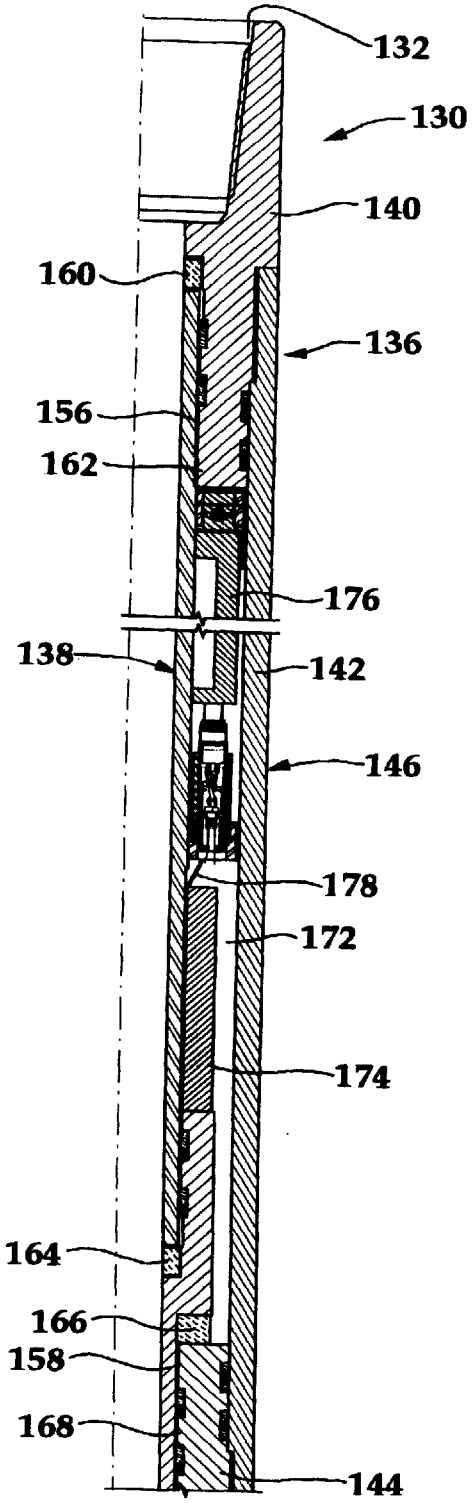
FIGS. 3A–3B are quarter-sectional views of a slave sonde of an adjacent well electromagnetic telemetry system of the present invention.
Figure 3B:
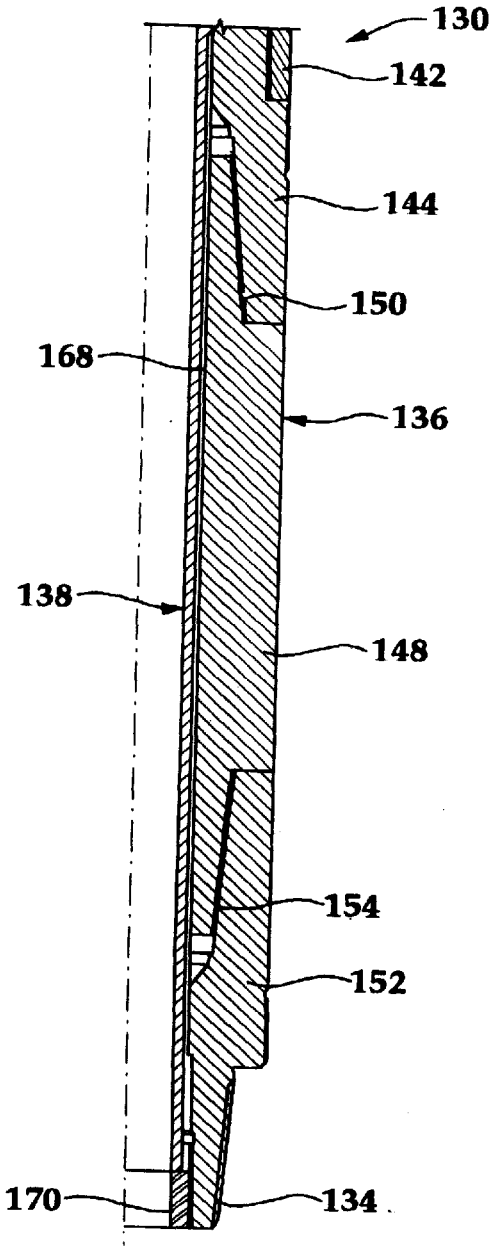

Representatively illustrated in FIGS. 3A–3B is a slave sonde 130 of the present invention. For convenience of illustration, FIGS. 3A–3B depicted slave sonde 130 in a quarter sectional view. Slave sonde 130 has a box end 132 and a pin end 134 such that slave sonde 130 is threadably adaptable to other tools in a final bottom hole assembly. Slave sonde 130 has an outer housing 136 and a mandrel 138 having a full bore such that when slave sonde 130 is disposed within a well, tubing may be inserted therethrough. Housing 136 and mandrel 138 protect to operable components of slave sonde 130 during installation and production.

Housing 136 of slave sonde 130 includes an axially extending and generally tubular upper connector 140. An axially extending generally tubular intermediate housing member 142 is threadably and sealably connected to upper connector 140. An axially extending generally tubular lower housing member 144 is threadably and sealably connected to intermediate housing member 142. Collectively, upper connector 140, intermediate housing member 142 and lower housing member 144 form upper subassembly 146. Upper subassembly 146 is electrically connected to the section of the casing above slave sonde 130.

An axially extending generally tubular isolation subassembly 148 is securably and sealably coupled to lower housing member 144. Disposed between isolation subassembly 148 and lower housing member 144 is a dielectric layer 150 that provides electric isolation between lower housing member 144 and isolation subassembly 148. Dielectric layer 150 is composed of a dielectric material chosen for its dielectric properties and capably of withstanding compression loads without extruding.

An axially extending generally tubular lower connector 152 is securably and sealably coupled to isolation subassembly 148. Disposed between lower connector 152 and isolation subassembly 148 is a dielectric layer 154 that electrically isolates lower connector 152 from isolation subassembly 148. Lower connector 152 is electrically connected to the portion of the casing 30 below slave sonde 130.

Mandrel 138 includes axially extending generally tubular upper mandrel section 156 and axially extending generally tubular lower mandrel section 158. Upper mandrel section 156 is partially disposed and sealing configured within upper connector 140. A dielectric member 160 electrically isolates upper mandrel section 156 and upper connector 140. The outer surface of upper mandrel section 156 has a dielectric layer disposed thereon. Dielectric layer 162 may be, for example, a teflon layer. Together, dielectric layer 162 and dielectric member 160 service to electrically isolate upper connector 140 from upper mandrel section 156.

Between upper mandrel section 156 and lower mandrel section 158 is a dielectric member 164 that, along with dielectric layer 162, serves to electrically isolate upper mandrel section 156 from lower mandrel section 158. Between lower mandrel section 158 and lower housing member 144 is a dielectric member 166. On the outer surface of lower mandrel section 158 is a dielectric layer 168 which, along with dielectric member 166, provides for electric isolation of lower mandrel section 158 with lower housing number 144. Dielectric layer 168 also provides for electric isolation between lower mandrel section 158 and isolation subassembly 148 as well as between lower mandrel section 158 and lower connector 152. Lower end 170 of lower mandrel section 158 is disposed within lower connector 152 and is in electrical communication with lower connector 152. Intermediate housing member 142 of outer housing 136 and upper mandrel section 156 of mandrel 138 define annular area 172. A transceiver 174 and an electronics package 176 are disposed within annular area 172.

In operation, slave sonde 130 receives a command signal in the form of electromagnetic wave fronts generated by an electromagnetic transmitter of a master sonde. Transceiver 174 forwards the command signal to electronics package 176 via electrical conductor 178. Electronics package 176 processes the command signal as will be discussed with reference to FIG. 12 and generates a driver signal. The driver signal is forwarded to the downhole device uniquely associated with the command signal to change the operational state of the downhole device. A verification signal is returned to electronics package 176 from the downhole device and is processed and forwarded to transceiver 174. Transceiver 174 transforms the verification signal into electromagnetic waves which are radiated into the earth and picked up by a receiver on the master sonde for transmission to surface installation 58 via electrical wire 60.

Figure 4A:
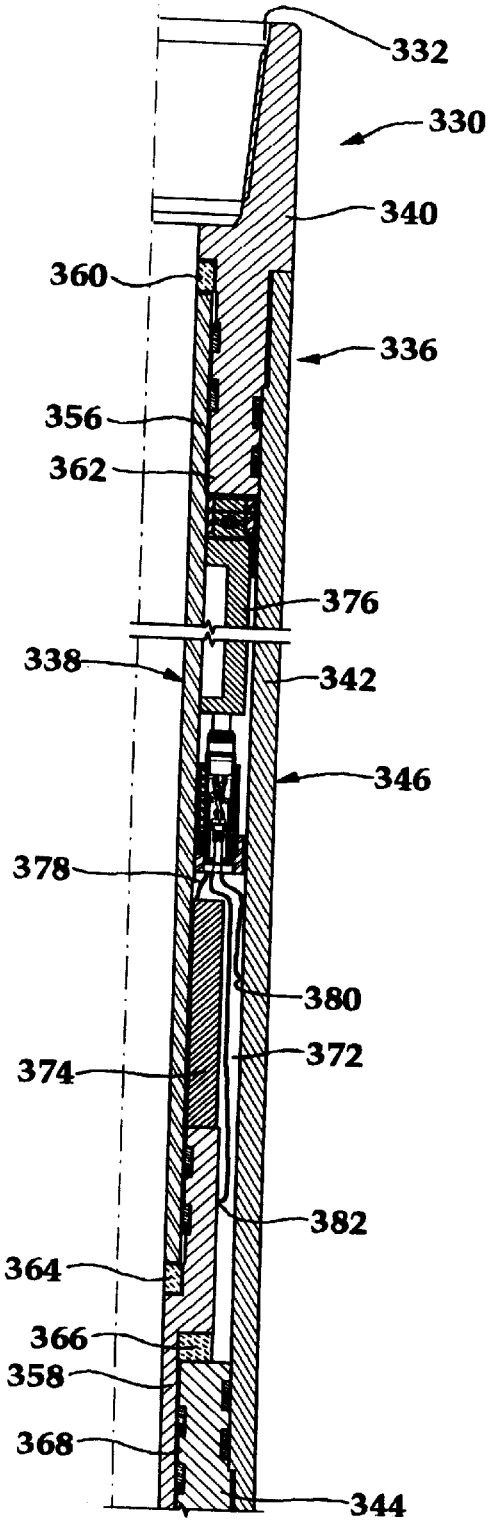
FIG. 4A–4B are quarter-sectional views of a slave sonde of an adjacent well electromagnetic telemetry system of the present invention.
Figure 4B:
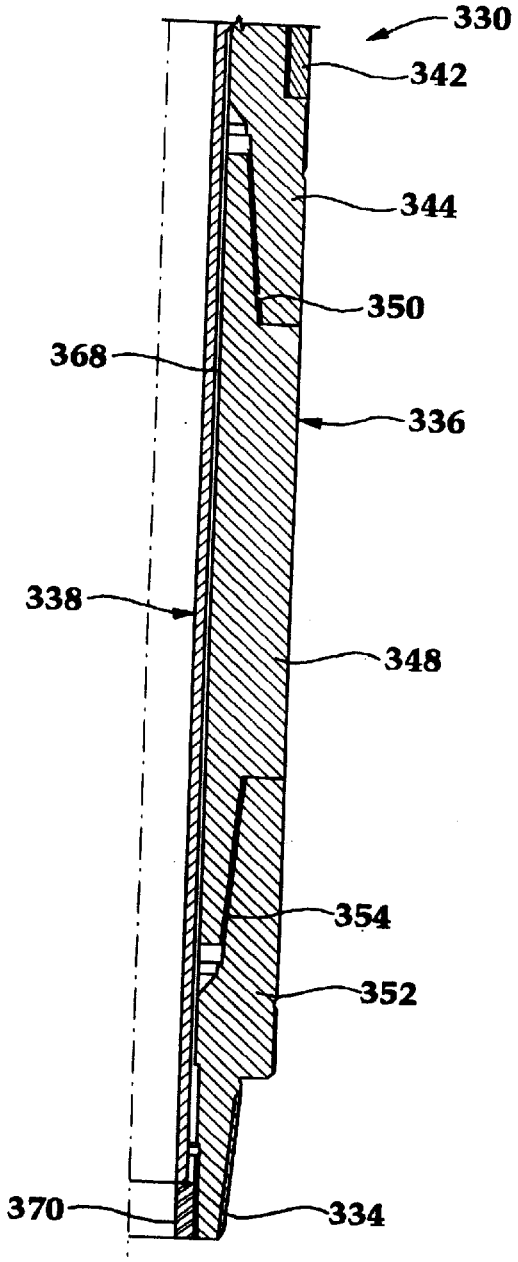

Representatively illustrated in FIGS. 4A–4B is another embodiment of a slave sonde 330 of the present invention. For convenience of illustration, FIGS. 4A–4B depicts slave sonde 330 in a quarter sectional view. Slave sonde 330 has a box end 332 and a pin end 334 such that slave sonde 330 is threadably adaptable to other tools in a final bottom hole assembly. Housing 336 and mandrel 338 protect to operable components of slave sonde 330 during installation and production.

Housing 336 of slave sonde 330 includes an axially extending and generally tubular upper connector 340. An axially extending generally tubular intermediate housing member 342 is threadably and sealably connected to upper connector 340. An axially extending generally tubular lower housing member 344 is threadably and sealably connected to intermediate housing member 342. Collectively, upper connector 340, intermediate housing member 342 and lower housing member 344 form upper subassembly 346. Upper subassembly 346 is electrically connected to the section of the casing above slave sonde 330.

An axially extending generally tubular isolation subassembly 348 is securably and sealably coupled to lower housing member 344. Disposed between isolation subassembly 348 and lower housing member 344 is a dielectric layer 350 that provides electric isolation between lower housing member 344 and isolation subassembly 348. Dielectric layer 350 is composed of a dielectric material chosen for its dielectric properties and capably of withstanding compression loads without extruding.

An axially extending generally tubular lower connector 352 is securably and sealably coupled to isolation subassembly 348. Disposed between lower connector 352 and isolation subassembly 348 is a dielectric layer 354 that electrically isolates lower connector 352 from isolation subassembly 348. Lower connector 352 is electrically connected to the portion of the casing below slave sonde 330.

Mandrel 338 includes axially extending generally tubular upper mandrel section 356 and axially extending generally tubular lower mandrel section 358. Upper mandrel section 356 is partially disposed and sealing configured within upper connector 340. A dielectric member 360 electrically isolates upper mandrel section 356 and upper connector 340. The outer surface of upper mandrel section 356 has a dielectric layer disposed thereon. Dielectric layer 362 may be, for example, a teflon layer. Together, dielectric layer 362 and dielectric member 360 service to electrically isolate upper connector 340 from upper mandrel section 356.

Between upper mandrel section 356 and lower mandrel section 358 is a dielectric member 364 that, along with dielectric layer 362, serves to electrically isolate upper mandrel section 356 from lower mandrel section 358. Between lower mandrel section 358 and lower housing member 344 is a dielectric member 366. On the outer surface of lower mandrel section 358 is a dielectric layer 368 which, along with dielectric member 366, provides for electric isolation of lower mandrel section 358 with lower housing number 344. Dielectric layer 368 also provides for electric isolation between lower mandrel section 358 and isolation subassembly 348 as well as between lower mandrel section 358 and lower connector 352. Lower end 370 of lower mandrel section 358 is disposed within lower connector 352 and is in electrical communication with lower connector 352. Intermediate housing member 342 of outer housing 336 and upper mandrel section 356 of mandrel 338 define annular area 372. A receiver 374 and an electronics package 376 are disposed within annular area 372. In operation, receiver 374 of slave sonde 330 receives a command signal in the form of electromagnetic waves generated by an electromagnetic transmitter of a master sonde. Receiver 374 forwards the command signal to electronics package 376 via electrical conductor 378. Electronics package 376 processes the command signal and generates a driver signal that is forwarded to the downhole device uniquely associated with the command signal to change the operational state of the downhole device. A verification signal is returned to electronics package 376 from the downhole device.

Electronics package 376 processes and amplifies the verification signal. Electronics package 376 then generates an output voltage that is applied between intermediate housing member 342 and lower mandrel section 358, which is electrically isolated from intermediate housing member 342 and electrically connected to lower connector 352, via terminal 380 on intermediate housing member 342 and terminal 382 on lower mandrel section 358. The voltage applied between intermediate housing member 342 and lower connector 352 generates electromagnetic waves that are radiated into the earth and picked up by a receiver on the master sonde for transmission to surface installation 58 via electrical wire 60.

Figure 5:
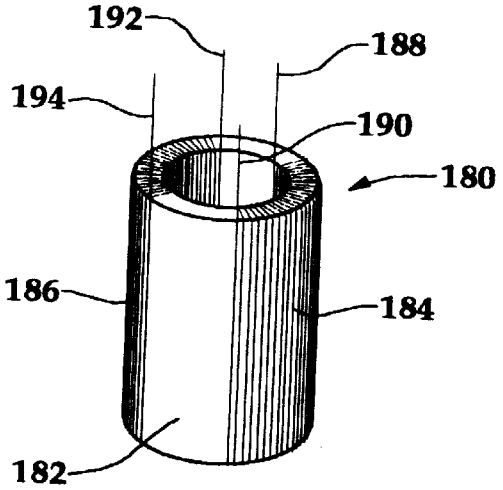
FIG. 5 is a schematic illustration of a toroid having primary and secondary windings wrapped therearound for a master sonde or slave sonde of an adjacent well electromagnetic telemetry system of the present invention.

Referring now to FIG. 5, a schematic illustration of a toroid is depicted and generally designated 180. Toroid 180 includes magnetically permeable annular core 182, a plurality of electrical conductor windings 184 and a plurality of electrical conductor windings 186. Windings 184 and windings 186 are each wrapped around annular core 182. Collectively, annular core 182, windings 184 and windings 186 serve to approximate an electrical transformer wherein either windings 184 or windings 186 may serve as the primary or the secondary of the transformer.

In one embodiment, the ratio of primary windings to secondary windings is 2:1. For example, the primary windings may include 100 turns around annular core 182 while the secondary windings may include 50 turns around annular core 182. In another embodiment, the ratio of secondary windings to primary windings is 4:1. For example, primary windings may include 10 turns around annular core 182 while secondary windings may include 40 turns around annular core 182. It will be apparent to those skilled in the art that the ratio of primary windings to secondary windings as well as the specific number of turns around annular core 182 will vary based upon factors such as the diameter and height of annular core 182, the desired voltage, current and frequency characteristics associated with the primary windings and secondary windings and the desired magnetic flux density generated by the primary windings and secondary windings.

Toroid 180 of the present invention may serve, for example, as electromagnetic receiver 120 or electromagnetic transmitter 124 of FIG. 2, electromagnetic transceiver 174 of FIG. 3 or electromagnetic receiver 374 of FIG. 4. The following description of the orientation of windings 184 and windings 186 will therefore be applicable to each of the above.

With reference to FIGS. 2 and 5, windings 184 have a first end 188 and a second end 190. First end 188 of windings 184 is electrically connected to electronics package 122. When toroid 180 serves as electromagnetic receiver 120, windings 184 serve as the secondary wherein first end 188 of windings 184 feeds electronics package 122 with the verification signal via electrical conductor 126. The verification signal is processed by electronics package 122 as will be further described with reference to FIG. 11 below. When toroid 180 serves as electromagnetic transmitter 124, windings 184 serve as the primary wherein first end 188 of windings 184, receives the command signal from electronics package 122 via electrical conductor 128. Second end 190 of windings 184 is electrically connected to upper subassembly 92 of outer housing 83 which serves as a ground.

Windings 186 of toroid 180 have a first end 192 and a second end 194. First end 192 of windings 186 is electrically connected to upper subassembly 92 of outer housing 83. Second end 194 of windings 186 is electrically connected to lower connector 98 of outer housing 83. First end 192 of windings 186 is thereby separated from second end 192 of windings 186 by isolations subassembly 94 which prevents a short between first end 192 and second end 194 of windings 186.

When toroid 180 serves as electromagnetic receiver 120, electromagnetic wave fronts, such as electromagnetic wave fronts 72 induce a current in windings 186, which serve as the primary. The current induced in windings 186 induces a current in windings 184, the secondary, which feeds electronics package 122 as described above. When toroid 180 serves as electromagnetic transmitter 124, the current supplied from electronics package 122 feeds windings 184, the primary, such that a current is induced in windings 186, the secondary. The current in windings 186 induces an axial current on the casing 30, thereby producing electromagnetic waves.

Due to the ratio of primary windings to secondary windings, when toroid 180 serves as electromagnetic receiver 120, the signal carried by the current induced in the primary windings is increased in the secondary windings. Similarly, when toroid 180 serves as electromagnetic transmitter 124, the current in the primary windings is increased in the secondary windings.

Figure 6:
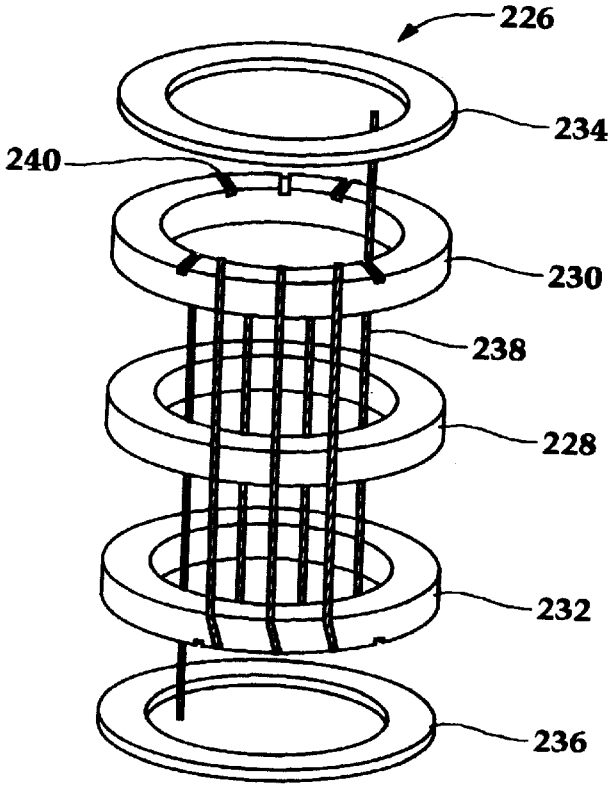
FIG. 6 is an exploded view of one embodiment of a toroid assembly for use as a receiver for a master sonde or slave sonde of an adjacent well electromagnetic telemetry system of the present invention.

Referring now to FIG. 6, an exploded view of a toroid assembly 226 is depicted. Toroid assembly 226 may be designed to serve, for example, as electromagnetic receiver 120 of FIG. 2. Toroid assembly 226 includes a magnetically permeable core 228, an upper winding cap 230, a lower winding cap 232, an upper protective plate 234 and a lower protective plate 236. Winding caps 230, 232 and protective plates 234, 236 are formed from a dielectric material such as fiberglass or phenolic. Windings 238 are wrapped around core 228 and winding caps 230, 232 by inserting windings 238 into a plurality of slots 240 which, along with the dielectric material, prevent electrical shorts between the turns of winding 238. For illustrative purposes, only one set of winding, windings 238, have been depicted. It will be apparent to those skilled in the art that, in operation, a primary and a secondary set of windings will be utilized by toroid assembly 226.

Figure 7:
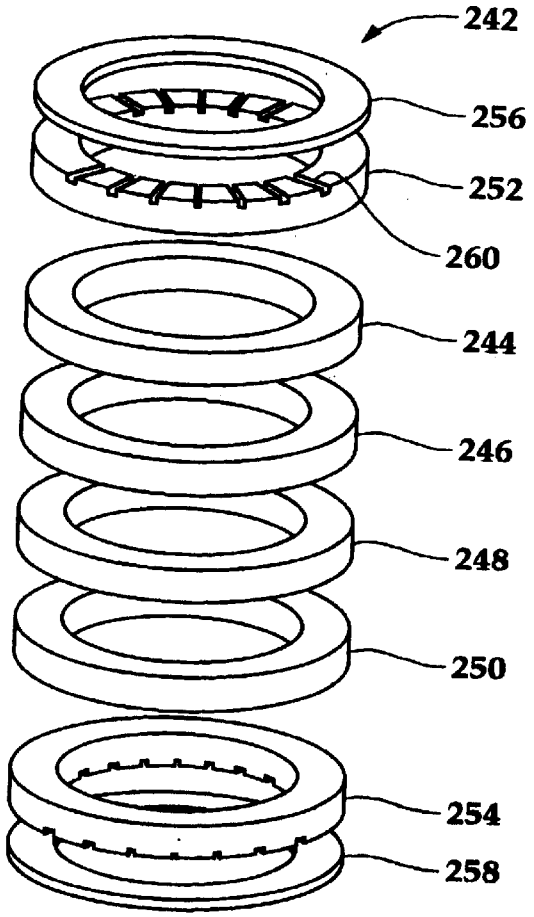
FIG. 7 is an exploded view of one embodiment of a toroid assembly for use as a transmitter for a master sonde or slave sonde of an adjacent well electromagnetic telemetry system of the present invention.

FIG. 7 depicts an exploded view of toroid assembly 242 which may serve, for example, as electromagnetic transmitter 124 of FIG. 2. Toroid assembly 242 includes four magnetically permeable cores 244, 246, 248 and 250 between an upper winding cap 252 and a lower winding cap 254. An upper protective plate 256 and a lower protective plate 258 are disposed respectively above and below upper winding cap 252 and lower winding cap 254. In operation, primary and secondary windings (not pictured) are wrapped around cores 244, 246, 248 and 250 as well as upper winding cap 252 and lower winding cap 254 through a plurality of slots 260.

Figure 8:
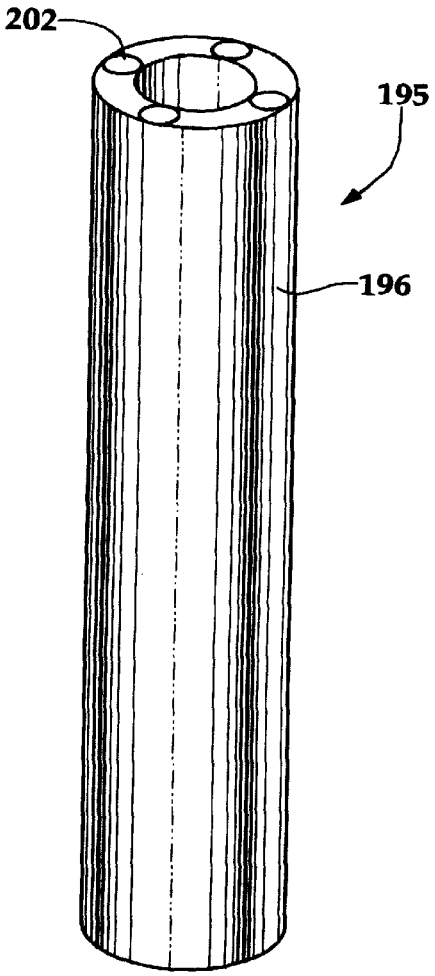
FIG. 8 is a perspective view of an annular carrier of an electronics package for a master sonde or slave sonde of an adjacent well electromagnetic telemetry system of the present invention.
Figure 9:
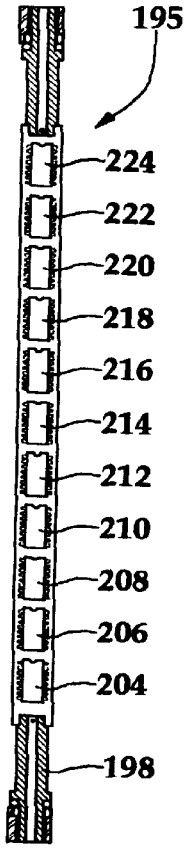
FIG. 9 is a perspective view of an electronics member having a plurality of electronic devices thereon for a master sonde or slave sonde of an adjacent well electromagnetic telemetry system of the present invention.
Figure 10:
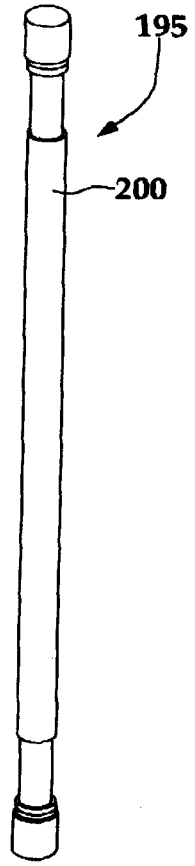
FIG. 10 is a perspective view of a battery pack for a master sonde or slave sonde of an adjacent well electromagnetic telemetry system of the present invention.

As is apparent from FIGS. 6 and 7, the number of magnetically permeable cores such as core 228 and cores 244, 246, 248 and 250 may be varied, dependent upon the required length for the toroid as well as whether the toroid serves as a receiver, such as toroid assembly 226, or a transmitter, such as toroid assembly 242. In addition, as will be known by those skilled in the art, the number of cores will be dependent upon the diameter of the cores as well as the desired voltage, current and frequency carried by the primary windings and the secondary windings, such as windings 238. Turning next to FIGS. 8, 9 and 10 collectively, therein is depicted the components of an electronics package 195 of the present invention. Electronics package 195 may serve as the electronics package used in the slave sondes described above. Electronics package 195 may also serve as the electronics package used in the master sonde described above but without the need for battery pack 200 as power is supplied to the master sonde from the surface installation 58 via electrical wire 60. Electronics package 195 includes an annular carrier 196, an electronics member 198 and one or more battery packs 200. Annular carrier 196 is disposed between outer housing 83 and mandrel 85. Annular carrier 196 includes a plurality of axial openings 202 for receiving either electronics member 198 or battery packs 200.

Even though FIG. 8 depicts four axial openings 202, it should be understood by one skilled in the art that the number of axial openings in annular carrier 196 may be varied. Specifically, the number of axial openings 202 will be dependent upon the number of battery packs 200 that are required.

Electronics member 198 is insertable into an axial opening 202 of annular carrier 196. Electronics member 198 receives a command signal from first end 188 of windings 184 when toroid 180 serves as, for example, electromagnetic transceiver 174 of FIG. 3. Electronics member 198 includes a plurality of electronic devices such as limiter 204, preamplifier 206, notch filter 208, bandpass filters 210, phase lock loop 212, clock 214, shift registers 216, comparators 218, parity check 220, storage device 222, and amplifier 224. The operation of these electronic devices will be more full discussed with reference to FIGS. 11 and 12.

Battery packs 200 are insertable into axial openings 202 of axial carrier 196. Battery packs 200, which includes batteries such as nickel cadmium batteries or lithium batteries, are configured to provide the proper operating voltage and current to the electronic devices of electronics member 198 and to toroid 180.

Figure 11:
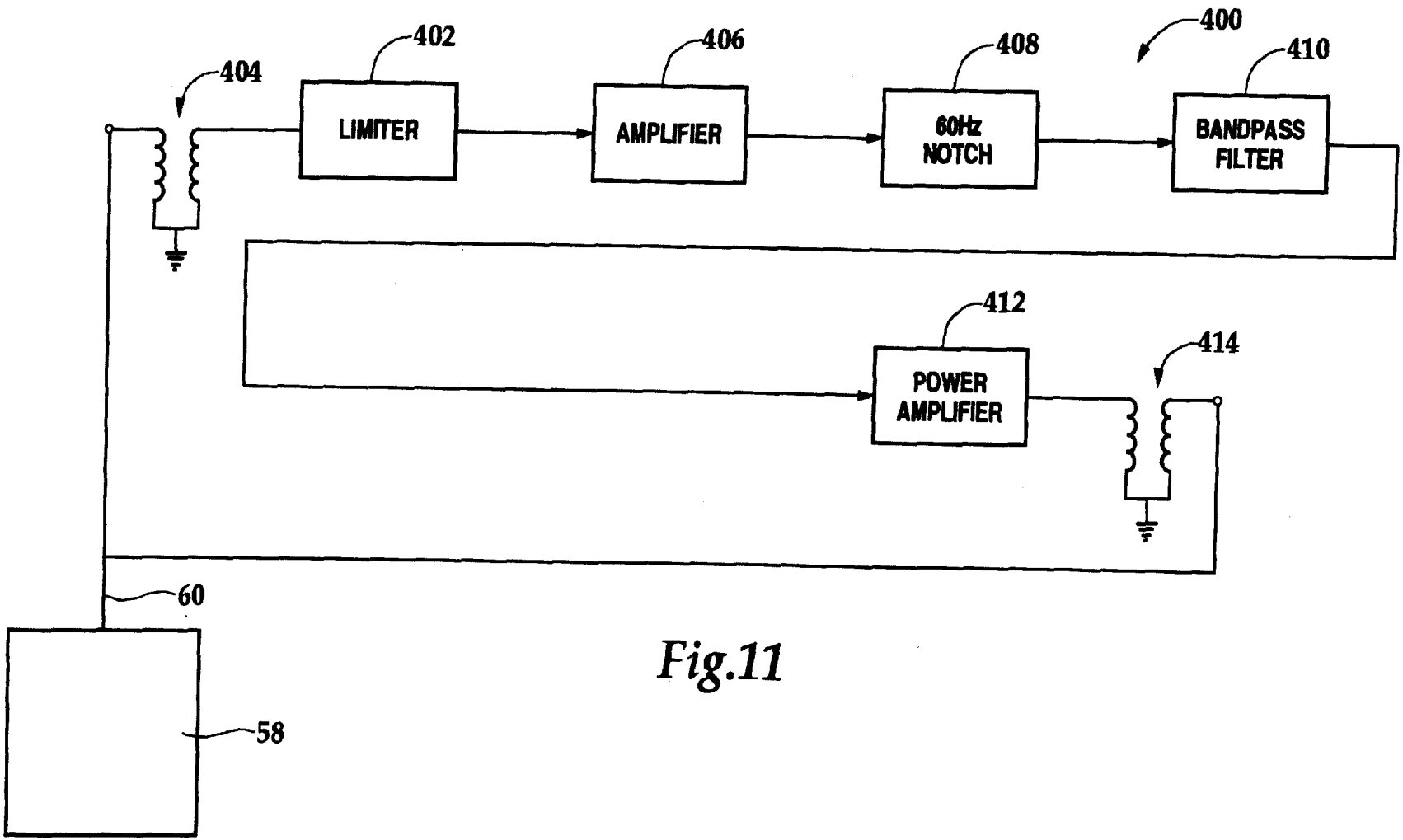
FIG. 11 is a block diagram of a signal processing method used by a master sonde of an adjacent well electromagnetic telemetry system of the present invention.

Turning now to FIG. 11 and with reference to FIG. 1, one embodiment of the method for processing the command signal by master sonde 46 is described. The method 400 utilizes a plurality of electronic devices such as those described with reference to FIG. 8. Method 400 provides for amplification and processing of the command signal that is generated by surface installation 58. Limiter 402 receives the command signal from receiver 404. Limiter 402 may include a pair of diodes for attenuating the noise in the command signal to a predetermined range, such as between about 0.3 and 0.8 volts. The command signal is then passed to amplifier 406 which may amplify the command signal to a predetermined voltage, acceptable for circuit logic, such as 5 volts. The command signal is then passed through a notch filter 408 to shunt noise at a predetermined frequency, such as 60 hertz which is a typical frequency for electrical noise in the United States whereas a European application may have a 50 hertz notch filter. The command signal then enters a bandpass filter 410 to eliminate noise above and below the desired frequency and to recreate the original waveform having the original frequency, for example, two hertz. The command signal is then increased in power amplifier 412 and passed on to electromagnetic transmitter 414. Transmitter 414 transforms the electrical command signal into an electromagnetic command signal, such as electromagnetic wave fronts 64, which are radiated into the earth to be picked up by electromagnetic receiver 66 of slave sonde 48 or electromagnetic receiver 76 of slave sonde 50.

In a similar manner, method 400 provides for amplification and processing of the verification signal generated by a slave sonde, such a slave sondes 48, 50. Limiter 402 receives the verification signal from receiver 404. Limiter 402 may attenuate the noise in the verification signal to a predetermined range, such as between 0.3 and 0.8 volts. The verification signal is then passed to amplifier 406 which may amplify the verification signal to a predetermined voltage, such as 5 volts. The verification signal is then passed through notch filter 408 to shunt noise at a predetermined frequency. The verification signal then enters bandpass filter 410 to eliminate unwanted frequencies above and below the desired frequency, for example, 2 hertz. The verification signal then passes into power amplifier 412 to boost the verification signal before the verification signal is transmitted to surface installation 58 via electrical wire 60.

Figure 12:
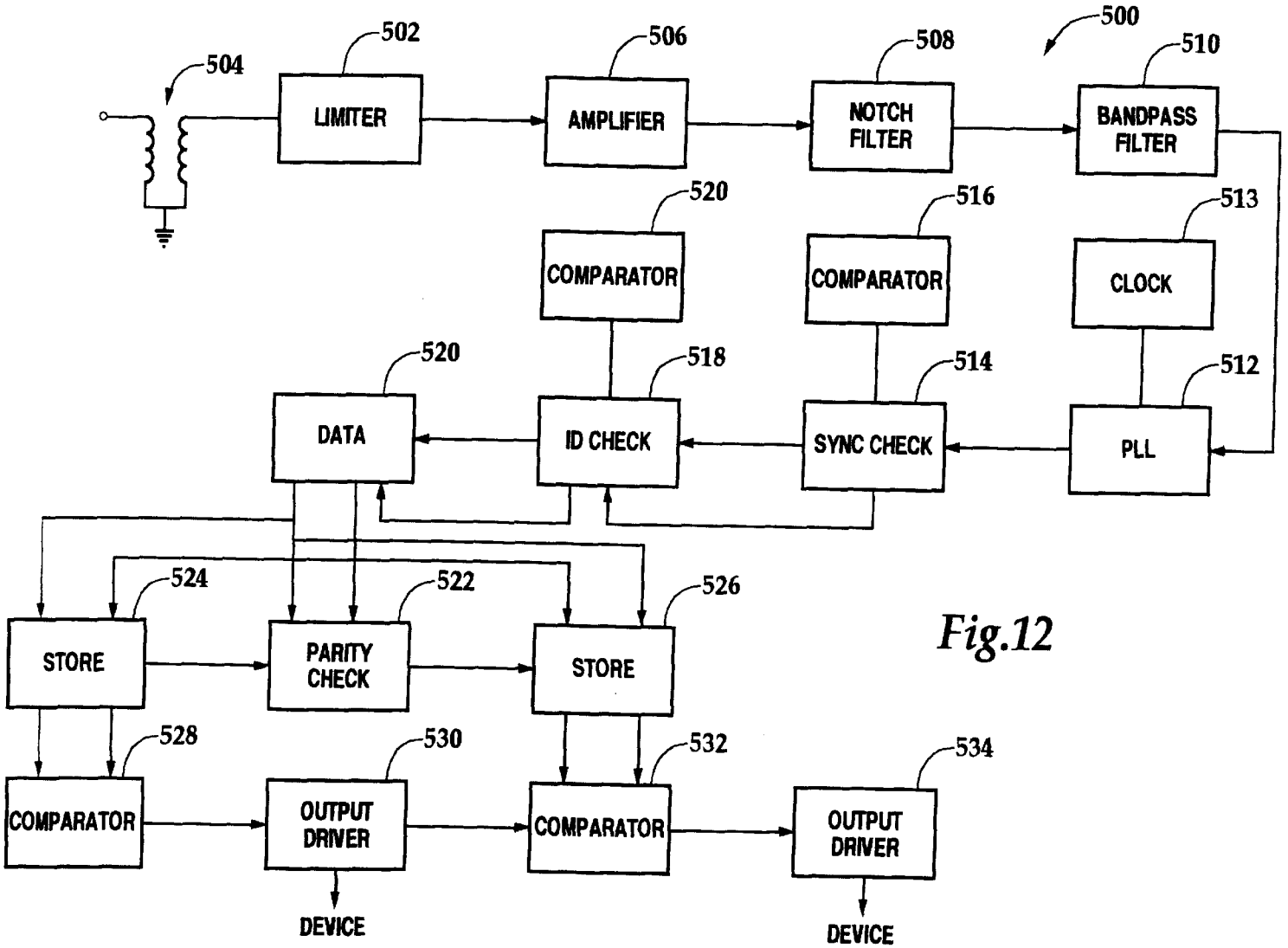
FIG. 12 is a block diagram of a signal processing method used by a slave sonde of an adjacent well electromagnetic telemetry system of the present invention.

Turning now to FIG. 12 and with reference to FIG. 1, one embodiment of the method for processing the command signal by slave sondes 48, 50 is described. The method 500 utilizes a plurality of electronic devices such as those described with reference to FIG. 8. Method 500 provides for digital processing of the command signal that is generated by surface installation 58 and electromagnetically transmitted by master sonde 46. Limiter 502 receives the command signal from electromagnetic receiver 504. Limiter 502 may include a pair of diodes for attenuating the noise in the command signal to a predetermined range, such as between about 0.3 and 0.8 volts. The command signal is then passed to amplifier 506 which may amplify the command signal to a predetermined voltage suitable for circuit logic, such as 5 volts. The command signal is then passed through a notch filter 508 to shunt noise at a predetermined frequency, such as 60 hertz. The command signal then enters a bandpass filter 510 to attenuate high noise and low noise and to recreate the original waveform having the original frequency, for example, two hertz.

The command signal is then fed through a phase lock loop 512 that is controlled by a precision clock 513 to assure that the command signal which passes through bandpass filter 510 has the proper frequency and is not simply noise. As the command signal will include a certain amount of carrier frequency first, phase lock loop 512 is able to verify that the received signal is, in fact, a command signal. The command signal then enters and series of shift registers that perform a variety of error checking features.

Sync check 514 reads, for example, the first six bits of the information carried in the command signal. These first six bits are compared with six bits that are stored in comparator 516 to determine whether the command signal is carrying the type of information intended for a slave sonde, such as slave sondes 48, 50. For example, the first 6 bits in the preamble of the command signal must carry the code stored in comparator 516 in order for the command signal to pass through sync check 514. Each of the slave sondes of the present invention, such as slave sonde 48 and slave sonde 50 may use the same code in comparator 516.

If the first six bits in the preamble correspond with that in comparator 516, the command signal passes to an identification check 518. Identification check 518 determines whether the command signal is uniquely associated with a specific downhole device controlled by that slave sonde. For example, the comparator 520 of slave sonde 48 will require a specific binary code while comparator 520 of slave sonde 50 will require a different binary code. Specifically, if the command signal is uniquely associated with bottom hole choke 62, the command signal will include a binary code that will correspond with the binary code stored in comparator 520 of slave sonde 48.

After passing through identification check 518, the command signal is shifted into a data register 520 which is in communication with a parity check 522 to analyze the information carried in the command signal for errors and to assure that noise has not infiltrated and abrogated the data stream by checking the parity of the data stream. If no errors are detected, the command signal is shifted into storage registers 524, 526. For example, once the command signal has been shifted into storage register 524, a binary code carried in the command signal is compared to that stored in comparator 528. If the binary code of the command signal matches that in comparator 528, the command signal is passed onto output driver 530. Output driver 530 generates a driver signal that is passed to the proper downhole device such that the operational state of the downhole device is changed. For example, slave sonde 50 may generate a driver signal to change the operational state of valve 88 from open to close.

Similarly, the binary code in the command signal that is stored in storage register 526 is compared with that in comparator 532. If the binary codes match, comparator 532 forwards the command signal to output driver 534. Output driver 534 generates a driver signal to operate another downhole device. For example, slave sonde 50 may generate a driver signal to change the operational state of sliding sleeve 80 from closed to open to allow formation fluids from the top of formation 14 to flow into well 26.

Once the operational state of the downhole device has been changed according to the command signal, a verification signal is generated and returned to slave sonde 50. The verification signal is processed by slave sonde 50 in a manner similar to that described above with reference to processing the verification signal by master sonde 64 corresponding to FIG. 11. After the verification signal is processed by slave sonde 50, the verification signal is passed on to electromagnetic transmitter 84 of slave sonde 50. Electromagnetic transmitter 84 transforms the verification signal into electromagnetic wave fronts 86, which are radiated into the earth to be picked up by electromagnetic receiver 56 of master sonde 46. As explained above, the verification signal is then processed in master sonde 46 and forwarded to surface installation 58 via electrical wire 60.

Even though FIG. 12 has described sync check 514, identifier check 518, data register 520 and storage registers 524, 526 as shift registers, it should be apparent to those skilled in the art that alternate electronic devices may be used for error checking and storage including, but not limited to, random access memory, read only memory, erasable programmable read only memory and a microprocessor.

Figure 13A:
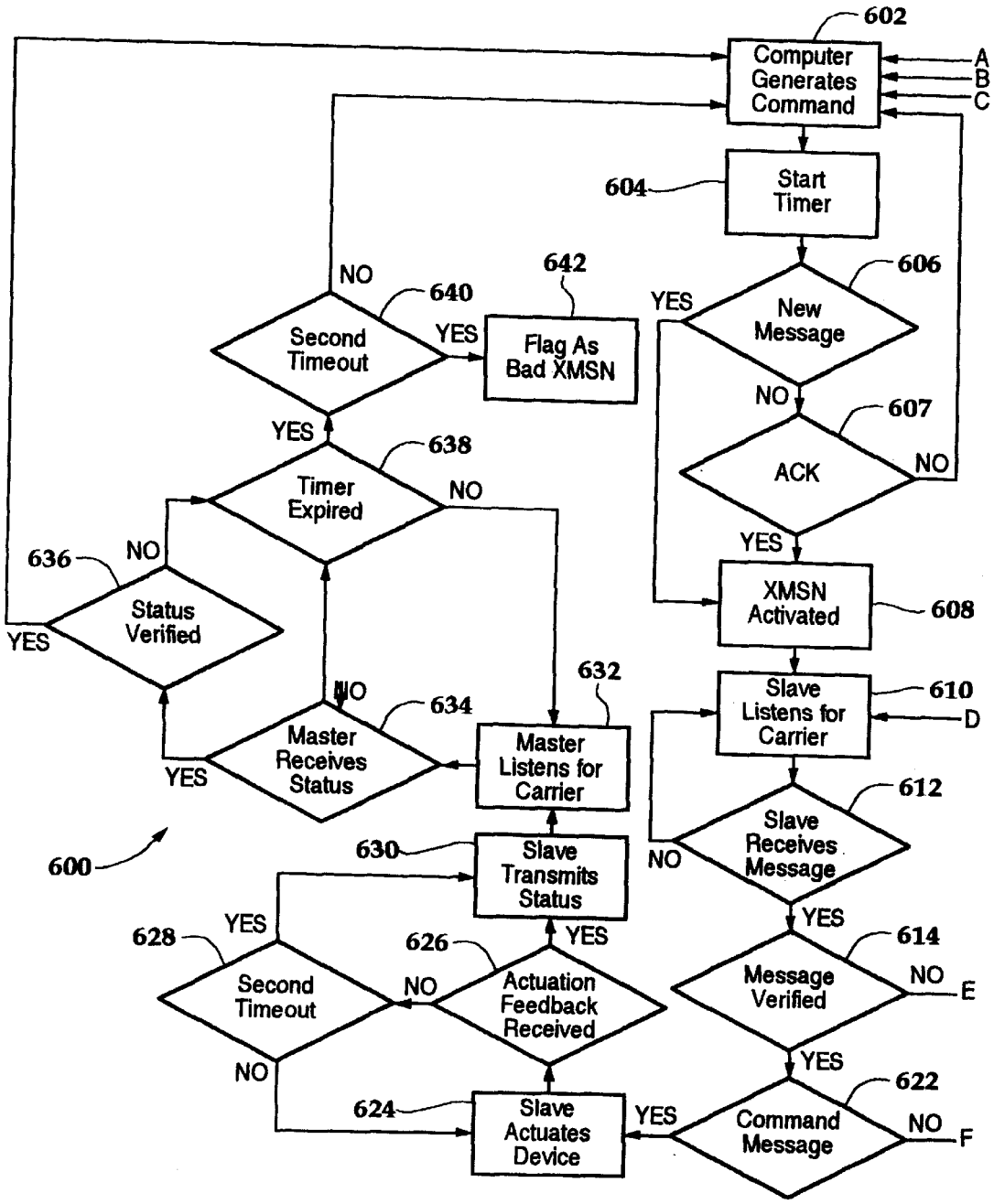
FIGS. 13A–B are flow diagrams of a method for operating an adjacent well electromagnetic telemetry system of the present invention.
Figure 13B:
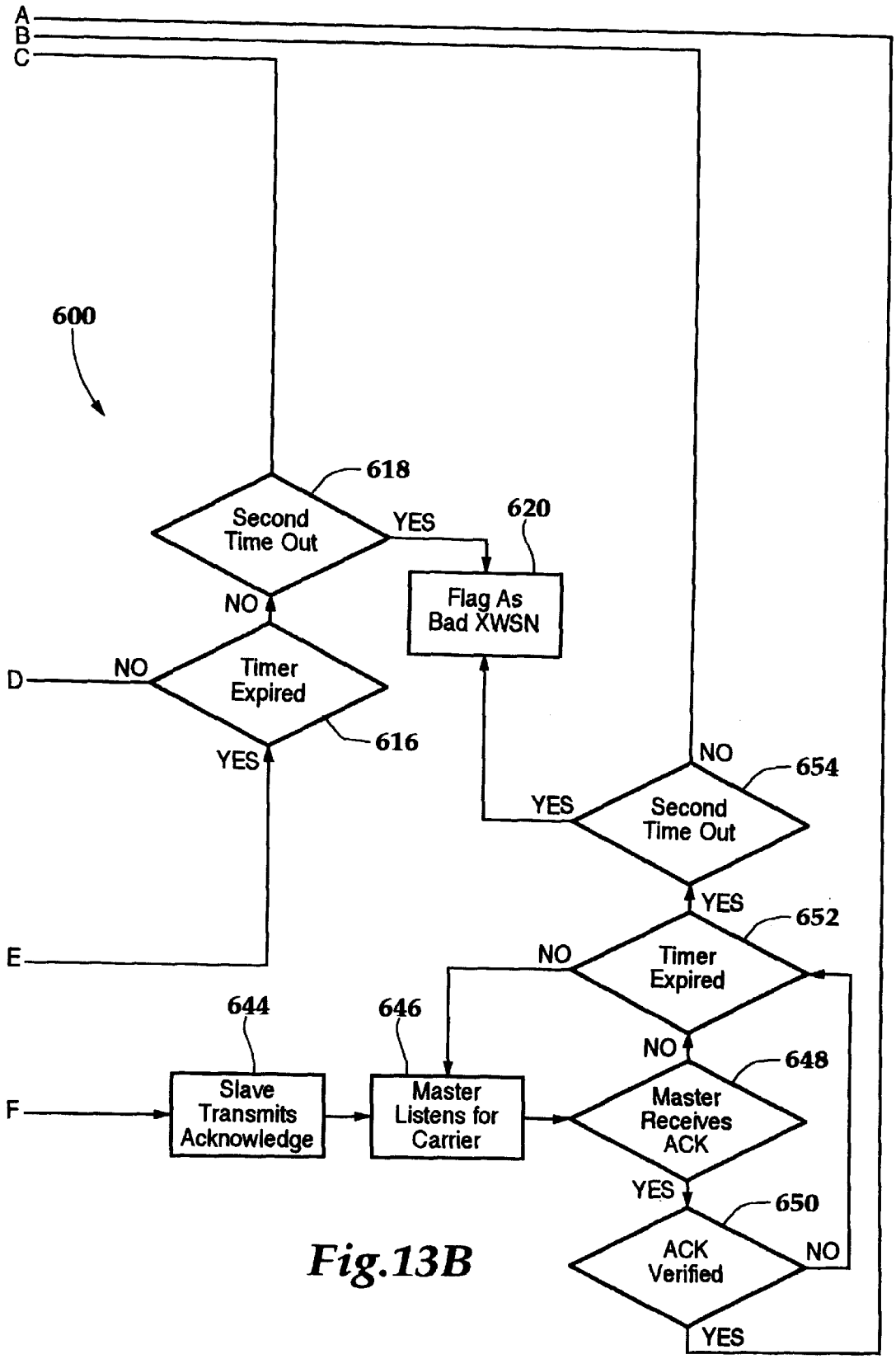

In FIGS. 13A–B, a method for operating an adjacent well telemetry system of the present invention is shown in a block diagram generally designated 600. The method begins with the generation of a command signal 602 by surface installation 58. When the command signal 602 is generated, a timer 604 is set. If the command signal 602 is a new message 606, surface installation 58 initiates the transmission of command signal 602 in step 608. If command signal 602 is not a new message, it must be acknowledged in step 607 prior to being transmitted in step 608.

Transmission 608 involves sending the command signal 602 to the master sonde via electrical wire 60 and generating electromagnetic waves by the master sonde. Slave sondes listen for the command signal 602 in step 610. When a command message 602 is received by a slave sonde in step 612, the command signal 602 is verified in step 614 as described above with reference to FIG. 12. If the slave sonde is unable to verify the command signal 602, and the timer has not expired in step 616, the slave sonde will continue to listen for the command signal in step 610. If the timer has expired in step 616, and a second time out occurs in step 618, the command signal is flagged as a bad transmission in step 620.

If the command signal 602 is requesting a change in the operational state of a downhole device, a driver signal is generated in step 622 such that the operational state of the downhole device is changed in step 624. Once the operational state of the downhole device has been changed, the slave sonde receives a verification signal from the downhole device in step 626. If the verification signal is not received, the slave sonde will again attempt to change the operational state of the downhole device in step 624. If a verification signal is not received after the second attempt to change the operational state of the downhole device, in step 628, a message is generated indicating that there has been a failure to change the operational state of the downhole device.

The status of the downhole device, whether operationally changed or not, is then transmitted by the slave sonde in step 630. The master sonde listens for the carrier in step 632 and receives the status signal in step 634, which is verified by the surface installation in step 636. If the master sonde does not receive the status message in step 634, the master sonde continues to listen for a carrier in step 632. If the timer has expired in step 638, and a second time out has occurred in step 640, the transmission is flagged as a bad transmission in step 642. Also, if the surface installation is unable to verify the status of the downhole device in step 636, the master sonde will continue to listen for a carrier in step 632. If the timers in steps 638, 640 have expired, however, the transmission will be flagged as a bad transmission in step 642.

In addition, the method of the present invention includes a check back before operate loop which may be used prior to the actuation of a downhole device. In this case, command message 602 will not change the operational state of a downhole device, in step 622, rather slave sonde will simply acknowledge the command signal 602 in step 644. The master sonde will listen for a carrier in step 646, receive the acknowledgment in step 648 and forward the acknowledgment to the surface installation for verification in step 650. If the master sonde does not receive the acknowledgment in step 648, the master sonde will continue to listen for a carrier in step 646. If the timers have expired in steps 652, 654, the transmission will be flagged as a bad transmission in step 620. Additionally, if the surface installation is unable to verify the acknowledgment in step 650, the master sonde will continue to listen for a carrier in step 646. If the timers in step 652 and step 654 have timed out, however, the transmission will be flagged as a bad transmission in step 620.

While this invention has been described with a reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. An adjacent well telemetry system for changing the operational state of at least one downhole device, the system comprising:

an electromagnetic transmitter disposed in a first wellbore for transmitting an command signal;

an electromagnetic receiver disposed in a second wellbore that is adjacent to the first wellbore for receiving the command signal; and an electronics package electrically connected to the electromagnetic receiver disposed in the second wellbore and operably connected to the downhole device, the electronics package generating a driver signal in response to the command signal that prompts the downhole device to change operational states.

2. The system as recited in claim 1 further comprising a surface installation for transmitting the command signal to the electromagnetic transmitter disposed in the first wellbore.

3. The system as recited in claim 2 further comprising an electrical wire electrically connecting the surface installation to the electromagnetic transmitter disposed in the first wellbore.

4. The system as recited in claim 1 wherein the electromagnetic transmitter disposed in the first wellbore further comprises a magnetically permeable annular core, a plurality of primary electrical conductor windings wrapped axially around the annular core and a plurality of secondary electrical conductor windings wrapped axially around the annular core.

5. The system as recited in claim 1 wherein the electromagnetic transmitter disposed in the first wellbore further comprises a pair of electrically isolated terminals between which a voltage is established.

6. The system as recited in claim 1 wherein the electromagnetic receiver disposed in the second wellbore further comprises a magnetically permeable annular core, a plurality of primary electrical conductor windings wrapped axially around the annular core and a plurality of secondary electrical conductor windings wrapped axially around the annular core.

7. The system as recited in claim 1 further comprising an electromagnetic transmitter disposed in the second wellbore for transmitting a verification signal.

8. The system as recited in claim 7 further comprising an electromagnetic receiver disposed in the first wellbore for receiving the verification signal.

9. The system as recited in claim 8 further comprising a surface installation for receiving the verification signal from the electromagnetic receiver disposed in the first wellbore.

10. The system as recited in claim 9 further comprising an electrical wire electrically connecting the surface installation to the electromagnetic receiver disposed in the first wellbore.

11. The system as recited in claim 8 wherein the electromagnetic receiver disposed in the first wellbore further comprises a magnetically permeable annular core, a plurality of primary electrical conductor windings wrapped axially around the annular core and a plurality of secondary electrical conductor windings wrapped axially around the annular core.

12. The system as recited in claim 7 wherein the electromagnetic transmitter disposed in the second wellbore further comprises a magnetically permeable annular core, a plurality of primary electrical conductor windings wrapped axially around the annular core and a plurality of secondary electrical conductor windings wrapped axially around the annular core.

13. The system as recited in claim 7 wherein the electromagnetic transmitter disposed in the second wellbore further comprises a pair of electrically isolated terminals between which a voltage is established.

14. The system as recited in claim 1 wherein the command signal further comprises a command signal uniquely associated with the downhole device.

15. The system as recited in claim 14 wherein the electronics package determines whether the command signal is uniquely associated with the downhole device.

16. The system as recited in claim 1 further comprising a plurality of downhole devices located at separate downhole location in the second wellbore.

17. The system as recited in claim 1 further comprising a plurality of downhole device located in a plurality of adjacent wellbores.

18. An adjacent well telemetry system for changing the operational state of at least one downhole device, the system comprising:

a surface installation for transmitting a command signal;

an electrical wire electrically connected to the surface installation;

an electromagnetic transmitter electrically connected to the electrical wire and disposed in a first wellbore, the electromagnetic transmitter electromagnetically transmitting the command signal;

an electromagnetic receiver disposed in a second wellbore that is adjacent to the first wellbore for receiving the command signal; and an electronics package electrically connected to the electromagnetic receiver disposed in a second wellbore and operably connected to the downhole device, the electronics package generating a driver signal in response to the command signal that prompts the downhole device to change operational states.

19. The system as recited in claim 18 wherein the electromagnetic transmitter disposed in the first wellbore further comprises a magnetically permeable annular core, a plurality of primary electrical conductor windings wrapped axially around the annular core and a plurality of secondary electrical conductor windings wrapped axially around the annular core.

20. The system as recited in claim 18 wherein the electromagnetic transmitter disposed in the first wellbore further comprises a pair of electrically isolated terminals between which a voltage is established.

21. The system as recited in claim 18 wherein the electromagnetic receiver disposed in the second wellbore further comprises a magnetically permeable annular core, a plurality of primary electrical conductor windings wrapped axially around the annular core and a plurality of secondary electrical conductor windings wrapped axially around the annular core.

22. The system as recited in claim 18 further comprising an electromagnetic transmitter disposed in the second wellbore for transmitting a verification signal.

23. The system as recited in claim 22 further comprising an electromagnetic receiver disposed in the first wellbore for receiving the verification signal.

24. The system as recited in claim 23 wherein the verification signal is transmitted to the surface installation from the electromagnetic receiver disposed in the first wellbore via the electrical wire.

25. The system as recited in claim 23 wherein the electromagnetic receiver disposed in the first wellbore further comprises a magnetically permeable annular core, a plurality of primary electrical conductor windings wrapped axially around the annular core and a plurality of secondary electrical conductor windings wrapped axially around the annular core.

26. The system as recited in claim 22 wherein the electromagnetic transmitter disposed in the second wellbore further comprises a magnetically permeable annular core, a plurality of primary electrical conductor windings wrapped axially around the annular core and a plurality of secondary electrical conductor windings wrapped axially around the annular core.

27. The system as recited in claim 22 wherein the electromagnetic transmitter disposed in the second wellbore further comprises a pair of electrically isolated terminals between which a voltage is established.

28. The system as recited in claim 18 wherein the command signal further comprises a command signal uniquely associated with the downhole device.

29. The system as recited in claim 28 wherein the electronics package determines whether the command signal is uniquely associated with the downhole device.

30. The system as recited in claim 18 further comprising a plurality of downhole device located at separate downhole location in the second wellbore.

31. The system as recited in claim 18 further comprising a plurality of downhole device located in a plurality of adjacent wellbores.

32. A method of changing the operational state of at least one downhole device comprising the steps of:

transmitting a command signal from an electromagnetic transmitter disposed in a first wellbore;

receiving the command signal on an electromagnetic receiver disposed in a second wellbore that is adjacent to the first wellbore;

generating a driver signal in response to the command signal; and changing the operational state of the downhole device.

33. The method as recited in claim 32 further comprising the step of transmitting the command signal from a surface installation to the electromagnetic transmitter disposed in the first wellbore.

34. The method as recited in claim 33 wherein the step of transmitting the command signal from a surface installation to the electromagnetic transmitter disposed in the first wellbore further comprises transmitting the command signal via an electrical wire.

35. The method as recited in claim 32 further comprising the step of transmitting a verification signal from an electromagnetic transmitter disposed in the second wellbore.

36. The method as recited in claim 35 further comprising the step of receiving the verification signal on an electromagnetic receiver disposed in the first wellbore.

37. The method as recited in claim 36 further comprising the step of transmitting the verification signal from the electromagnetic receiver disposed in the first wellbore to a surface installation.

38. The method as recited in claim 37 wherein the step of transmitting the verification signal from the electromagnetic receiver disposed in the first wellbore to a surface installation further comprises transmitting the verification signal via an electrical wire.

39. The method as recited in claim 32 wherein the step of transmitting a command signal from an electromagnetic transmitter disposed in a first wellbore further comprises transmitting a command signal uniquely associated with the downhole device.

40. The method as recited in claim 39 further comprising the step of determining whether the command signal is uniquely associated with the downhole device.

41. The method as recited in claim 32 further comprising a plurality of downhole device located at separate downhole location in the second wellbore.

42. The method as recited in claim 32 further comprising a plurality of downhole device located in a plurality of adjacent wellbores.

43. A method of changing the operational state of at least one downhole device comprising the steps of:

transmitting an command signal from a surface installation to an electromagnetic transmitter disposed in a first wellbore via an electrical wire;

transmitting the command signal from the electromagnetic transmitter disposed in the first wellbore;

receiving the command signal on an electromagnetic receiver disposed in a second wellbore that is adjacent to the first wellbore;

generating a driver signal in response to the command signal; and changing the operational state of the downhole device.

44. The method as recited in claim 43 further comprising the step of transmitting a verification signal from an electromagnetic transmitter disposed in the first wellbore.

45. The method as recited in claim 44 further comprising the step of receiving the verification signal on an electromagnetic receiver disposed in the first wellbore.

46. The method as recited in claim 45 further comprising the step of transmitting the verification signal from the electromagnetic receiver disposed in the first wellbore to the surface installation via the electrical wire.

47. The method as recited in claim 43 wherein the command signal further comprises a command signal uniquely associated with the downhole device.

48. The method as recited in claim 47 further comprising the step of determining whether the command signal is uniquely associated with the downhole device.

49. The method as recited in claim 43 further comprising a plurality of downhole device located at separate downhole location in the first wellbore.

50. The method as recited in claim 43 further comprising a plurality of downhole device located in a plurality of adjacent wellbores.

* * * * *